United States Patent [19]

Cox

[11] Patent Number: 4,666,340

[45] Date of Patent: May 19, 1987

[54] OFFSHORE PLATFORM WITH REMOVABLE MODULES

[75] Inventor: Bobby E. Cox, Kenner, La.

[73] Assignee: Shell Offshore Inc., Houston, Tex.

[21] Appl. No.: 845,301

[22] Filed: Mar. 28, 1986

[51] Int. Cl.[4] ..... E02D 21/00

[52] U.S. Cl. ..... 405/204; 405/195; 52/637; 166/340; 166/342

[58] Field of Search ..... 405/195, 204; 52/79.1, 52/637; 166/340, 341, 342

[56] References Cited

U.S. PATENT DOCUMENTS

| | | | |
|---|---|---|---|
| 2,679,898 | 6/1954 | Forsyth et al. . | |
| 2,765,200 | 10/1956 | Moyer | 52/637 |
| 3,934,658 | 1/1976 | Nelson | 405/204 |
| 4,192,383 | 3/1980 | Kirkland et al. | 166/341 |
| 4,426,173 | 1/1984 | Richart et al. | 405/195 |
| 4,437,521 | 3/1984 | Richardson et al. | 166/341 |
| 4,438,817 | 3/1984 | Pokladnik et al. | 166/341 |
| 4,492,270 | 1/1985 | Horton | 405/204 |
| 4,561,803 | 12/1985 | Campo et al. | 405/195 |
| 4,625,805 | 12/1986 | Ladecky | 405/203 |

*Primary Examiner*—Richard J. Scanlan, Jr.
*Assistant Examiner*—Kristina I. Hall

[57] ABSTRACT

A method and apparatus for positioning drilling equipment modules on an offshore platform apparatus which are removeably connected to the platform and adapted to contain equipment associated with the drilling of wells. A major portion of the equipment is secured to and within the modules and is simultaneously removeable with the modules as a unit when drilling operations on the platform apparatus have been completed. The drilling equipment modules are transported to a second location which may be either a jacket positioned on the ocean floor or a storage yard for future use of the modules on another platform. Alternatively, production equipment modules containing previously-installed equipment associated with the production of well fluids and being of a size and arrangement to be interchangeable with drilling equipment modules are subsequently lowered onto the platform apparatus next to the wellhead equipment modules after drilling operations on the platform apparatus have been completed.

22 Claims, 13 Drawing Figures

20
22
24
26
28
29
30
32
34
35
36
37
38
39
40
42
47
48
49
50
52
54
56

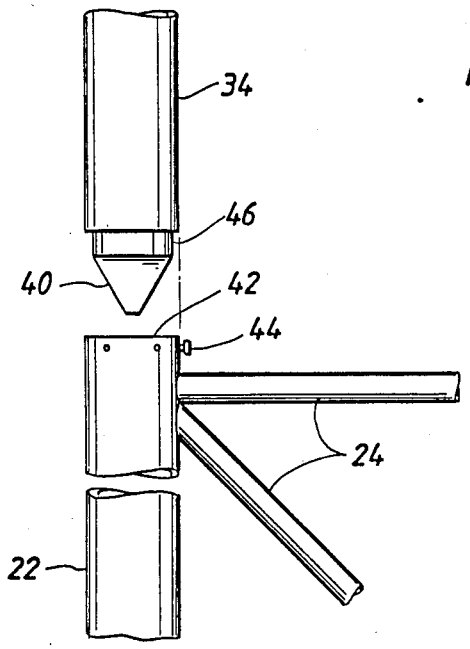
FIG. 3
FIG. 5
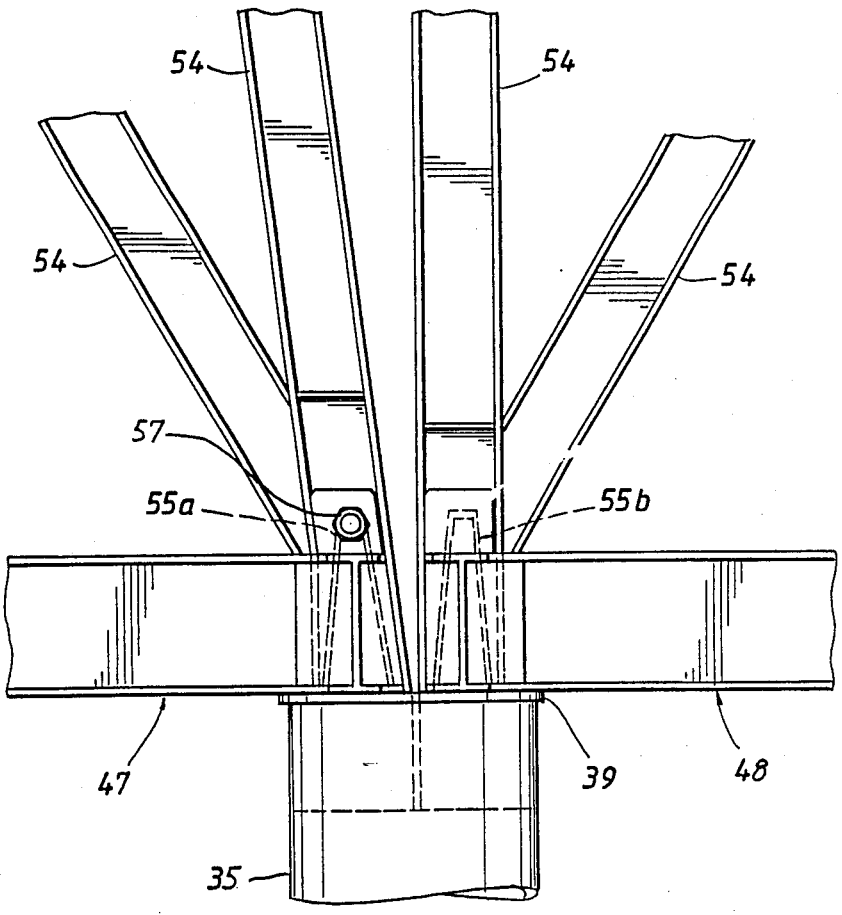

FIG. 10
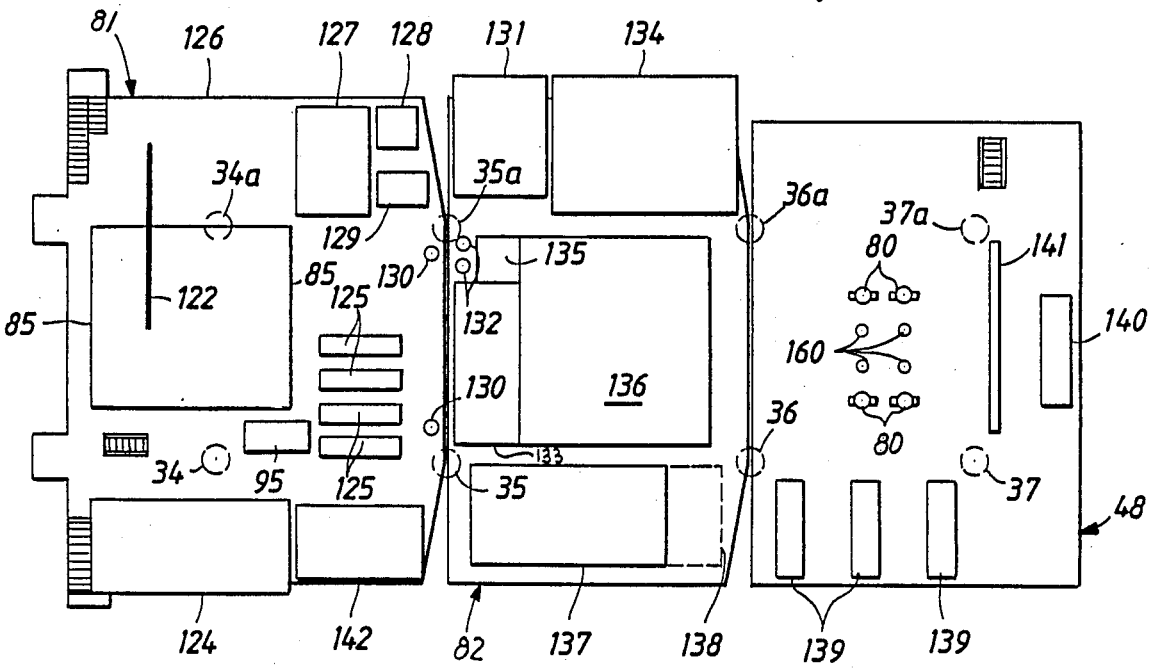
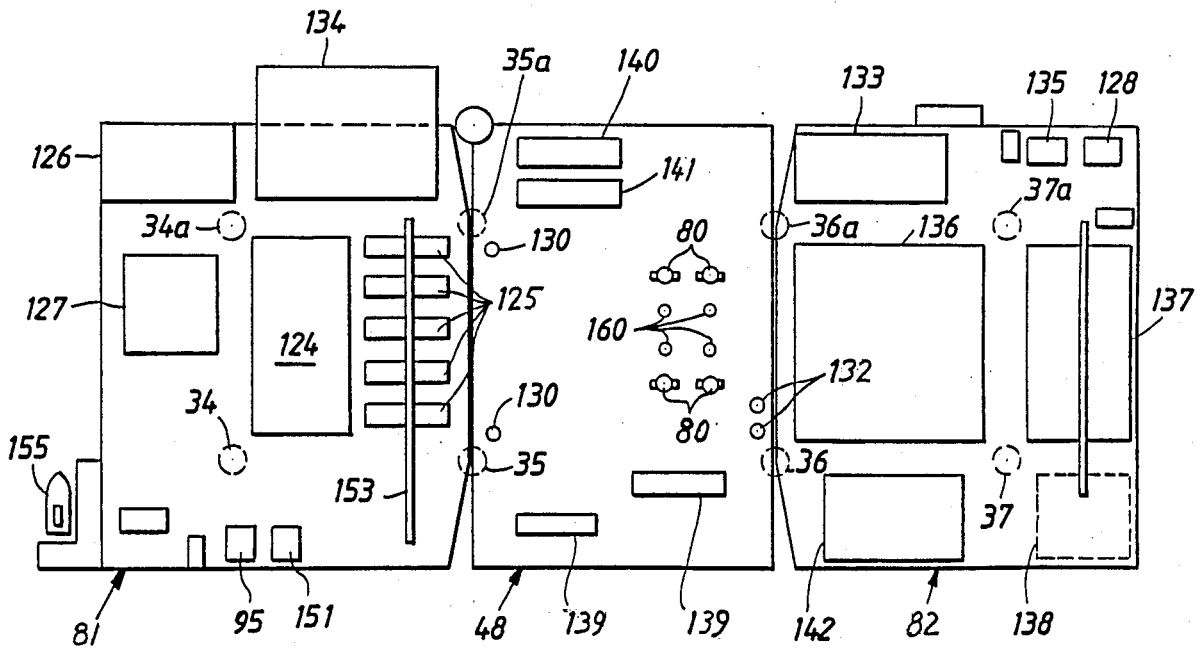
FIG. 11

OFFSHORE PLATFORM WITH REMOVABLE MODULES

BACKGROUND OF THE INVENTION

This invention relates to a method and apparatus whereby drilling equipment modules may be mounted on the tops of a substructure or jacket of an offshore platform apparatus for the purpose of drilling one or more hydrocarbon wells. After this work is completed, the drilling modules together with other associated equipment can be moved to another location where a substructure and well module have been installed, or onshore until the module is used again. Production equipment modules, being of a size and arrangement to be interchangeable with the drilling equipment modules, are then positioned on the substructure next to the wellhead module.

Present day offshore platforms used in the oil and gas industry are often formed by installing drilling equipment on the decks of a substructure and then production equipment after the drilling equipment has been removed. Generally, the deck and substructure requires approximately 10 to 12 months for construction. For shallow water developments (less than 150 feet water depth), the assembling of the deck usually controls the fabrication time. Installation of a deck on a jacket usually requires two derrick barges to lift the 1000–1400 ton deck. After the wells have been drilled and completed, post drilling, deck cleaning and painting is required. The installation of production equipment on the deck requires substantial interconnecting piping, electrical, and instrumentation hookup time. In addition, normal preparation for a facility setting (installation of setting guides, structural beef-up, etc.) is required. Furthermore, the production skid must be sized to contain processing equipment.

It is an object of the present invention to provide a method and apparatus incorporating the use of self-contained drilling equipment modules which form at least a portion of the deck of a substructure which are subsequently replaced by production equipment modules after the drilling equipment modules have been transported to a jacket at another drilling location.

SUMMARY OF THE INVENTION

The present invention is directed to a method and apparatus for providing drilling and production equipment modules which form the decks of an offshore platform. The deck of the platform preferably includes three double-deck modules; a wellhead equipment module and two deck modules. On the first well, the wellhead equipment module and empty deck drilling equipment modules are placed on the tops of the legs or nodes of a substructure. Next, the drilling rig is set on the deck just as in present rig moves, with the lower deck packages installed first and then the main drilling equipment packages placed on the upper truss row cords of the modules. After completion of the drilling program, the drilling rig and the equipment packages on the upper decks of the modules are removed. The previously-empty deck modules (500–600 tons each) are then removed from the substructure with the lower deck drilling equipment in place in the modules. The drilling rig, with its equipment deck modules are transported to another location which may be either another offshore platform or onshore for storage until the modules are used again.

After removal of the drilling equipment modules, the production equipment modules are installed.

In prior art platform developments, the production facilities for the wells being drilled are fabricated during the course of the drilling program and assembled on the offshore platform after the drilling rig has been removed. With the modular deck concept of the present invention, most or all lower deck production equipment would be installed and hooked up within the deck modules while onshore rather than being assembled offshore on the platform. The modular deck concept allows the production equipment or facility modules to be designed with size, head room and geometry to meet the specific production equipment requirements of the development. The modules can be "custom built" for any production scheme from a minimum facility to a major oil and gas facility. On small facilities, some of the processing equipment currently on the production skid could be placed within the module on the lower deck onshore, thus reducing the size of the skid, and the cost of the production facility. The production equipment modules are positioned on the tops of the nodes of the substructure first and then the upper deck packages (production skid, compressor, quarters, etc.) are set on these modules. Interconnecting piping work is then completed and the facility startup proceeds as in current field development programs, in a manner well known to the art.

One advantage of the present invention is that the modular decks can be built on the ground more efficiently than the present deck. Fabrication cost savings are substantially reduced for each deck. Also, the deck modules and substructure can be set offshore with a single derrick barge capable of lifting approximately 800 tons at a 100 foot radius. Installation costs per platform are also substantially reduced.

Another advantage of the present invention is the substantial reduction in the post drilling deck cleaning and painting since the drilling rig modules move from one structure to another.

With the modular deck design, all of the lower deck drilling rig equipment is installed on the modules and remains in place during a rig move to another platform. This reduces the rig move time. In addition, careful planning of the connections between rig packages reduces the rig move time even more. Once the drilling equipment modules for all rigs used are built, the fabrication time required for installing decks on platforms will be shortened considerably.

A principal object of the present invention to provide a method of alternatively moving large groups or packages of either well drilling equipment or well production equipment on or off an offshore platform or jacket of reduced size which does not have the space or lacks the foundation support to have both drilling and production equipment on at the same time.

The modular concept of the present invention could result in the use of a single production equipment module for small gas fields or developments requiring only minimum facilities. Such facility modules are moveable from platform to platform for short life oil or gas fields. Also, in cases where redevelopment drilling utilizing a platform rig is desired, the removal of one or more production equipment modules and their subsequent reinstallation is quicker and less costly with the modular facilities.

A further advantage of the modular concept is that it lends itself to the formation of platform decks having either an end bay or center bay configuration for the drilling and production modes.

Personal safety and ease of operation are the main points considered when evaluating the impact of well conductor location within a platform. Center bay drilling provides the opportunity to separate the processing equipment from the living quarters and utility equipment by placing a wellbay between the two. In the end bay configuration, the personnel living quarters are located as far away as possible from the wells in the drilling and producing modes. Because of greater potential for uncontrolled flow from a wellhead, the wellbay may be considered the greater hazard and, therefore, is preferably farthest from the living quarters.

In the end bay configuration, workover/completion operations are more separated from the producing operations than from the center bay configuration. The production equipment is less vulnerable to damage during rig equipment and supply handling operations on the platform. The handling operations will take place over the end of the platform, well away from any production skid. Also, the production personnel are much further away from the well area should the rig lose well control during workover or completion operations.

Except as limited by water depths, end bay drilling allows the utilization of cantilever jackup rigs for the drilling and workover of wells without the need of a skid-off system to place a mobile rig derrick onto the platform. Also, with this configuration, the jackup rigs may be used for redevelopment drilling without having to remove the production facilities.

Accessibility to the wells for capping, salvage or repair in a blowout situation is greatly increased in end bay drilling. Also, should the wells on the end of the platform catch fire, they are less likely to cause a catastrophic failure of platform deck. However, the wells are more exposed to damage resulting from a vessel collision with the platform.

The end bay configuration presents a less eccentric distribution of deck loads to the pilings for both drilling and production operations. However, present analysis tools in use for platform design are sufficiently sophisticated to handle the eccentric platform wave loading presented by end bay drilling. Other advantages of end bay drilling include better visibility of the crane operator during workover operations of the wells together with improved supply boat mooring flexibility, and a more accessible approach/departure path access to the heliport.

The various features of novelty which characterize the invention are pointed out with particularity in the claims forming a part of this disclosure. For a better understanding of the invention, its operating advantages and specific object obtained by its uses, reference should be made to the accompanying drawings and descriptive matter in which there are illustrated preferred embodiments of the invention.

A BRIEF DESCRIPTION OF THE DRAWINGS

FIG. 3 is a longitudinal view illustrating the connector means and orienting means of the substructure to the jacket;

Figures 1, 2, 4A, 4B, 4C:
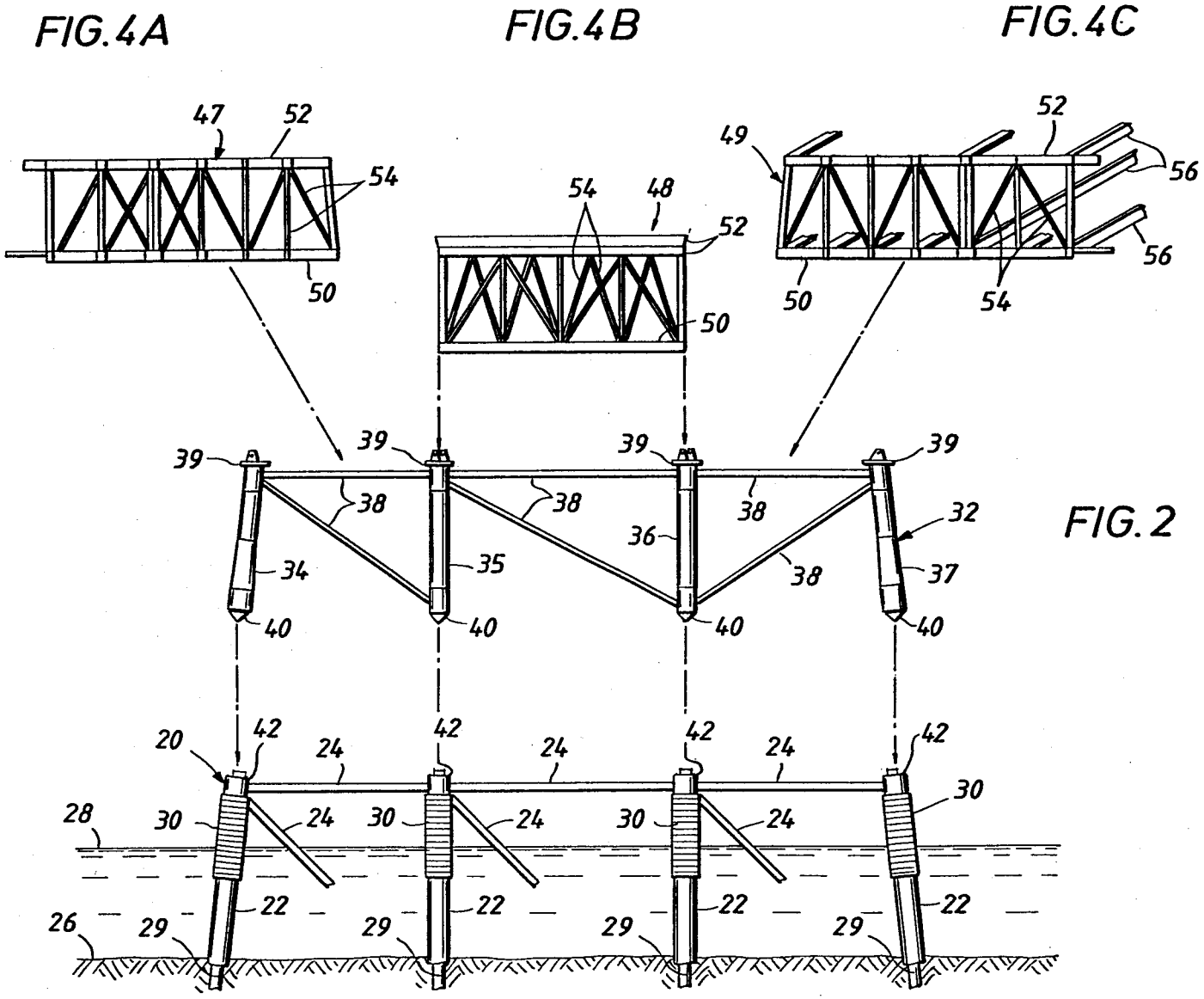
FIG. 1 is a diagrammatic view of the upper portion of an offshore platform apparatus jacket.
FIG. 2 is a diagrammatic view of an offshore platform apparatus substructure.
Figure 6:
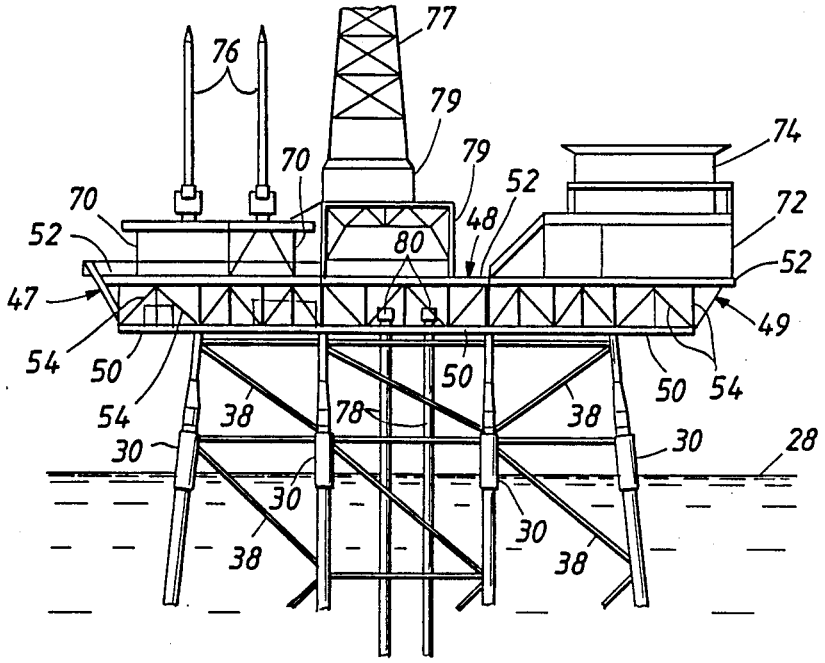
Figure 6:
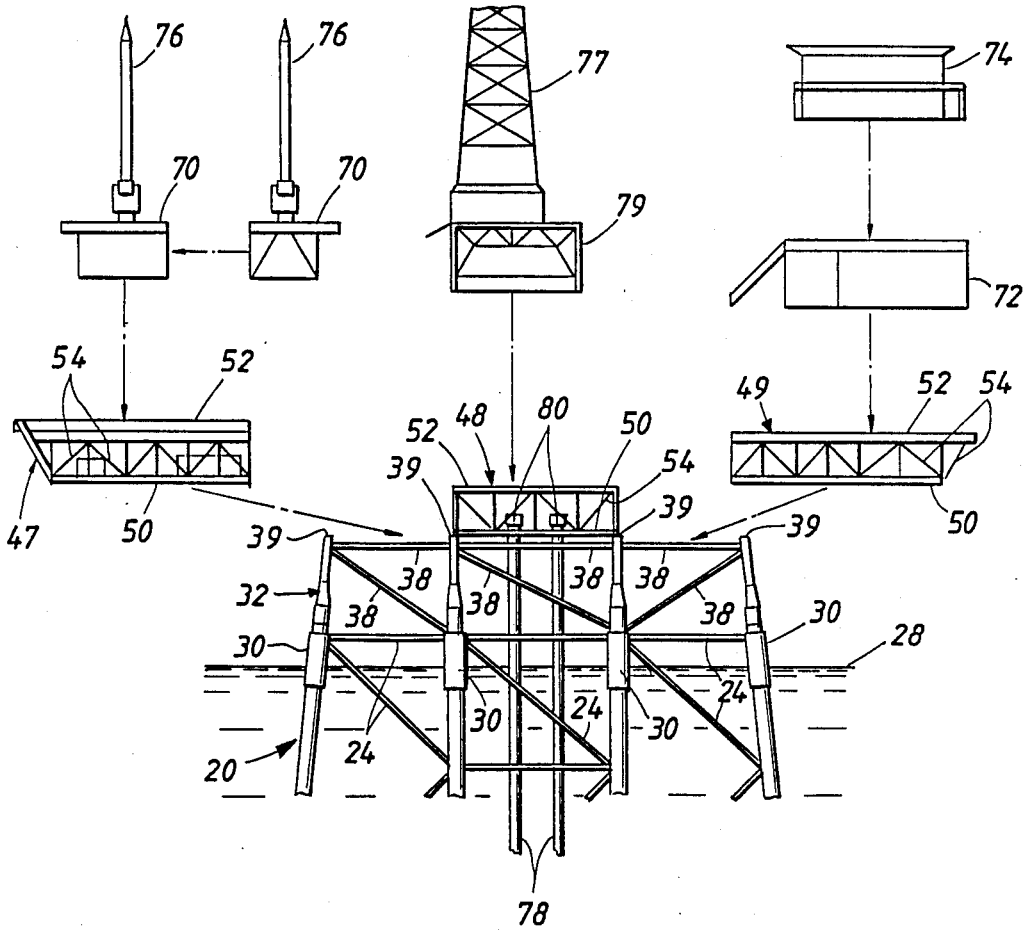
Figure 7:
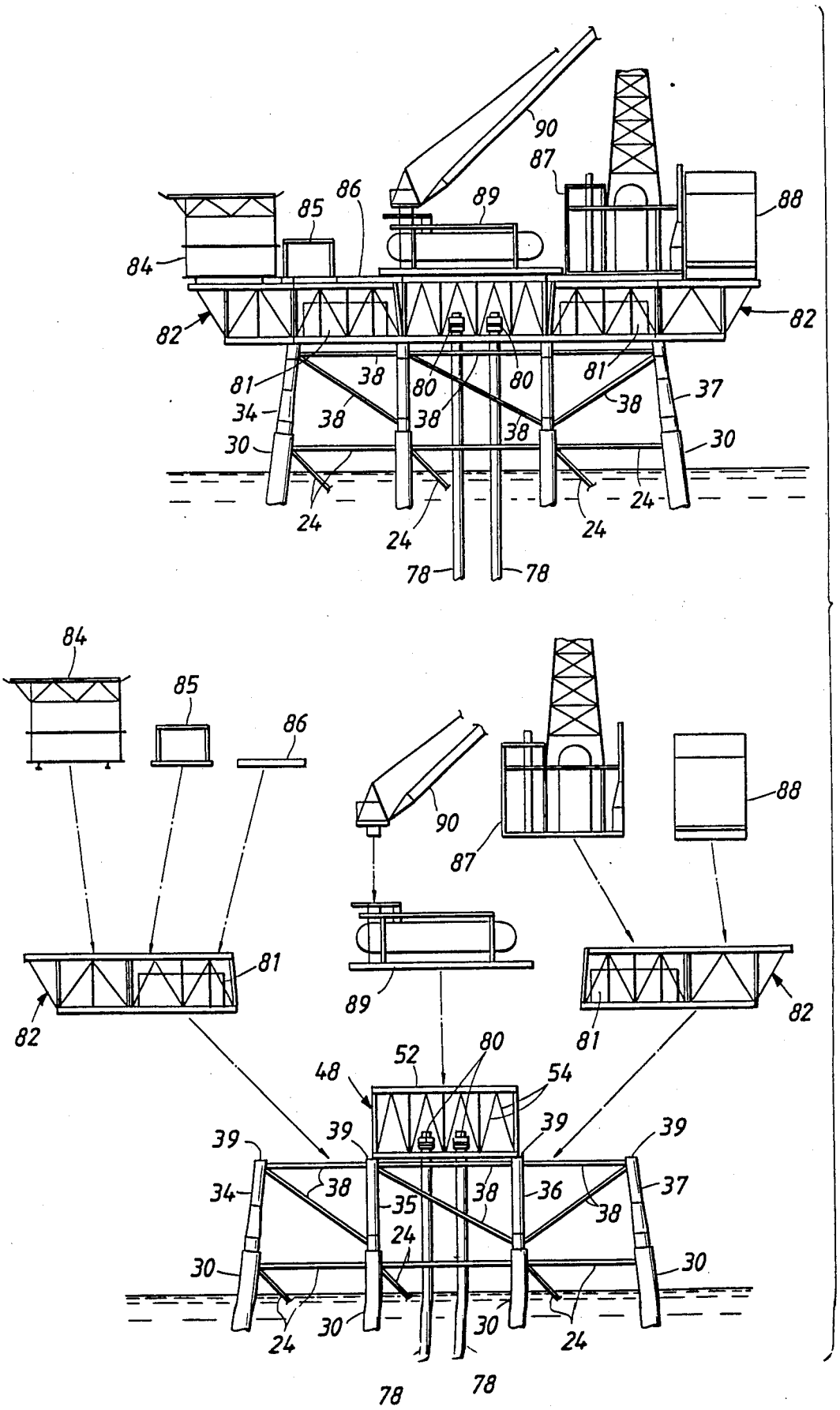
Figure 8:
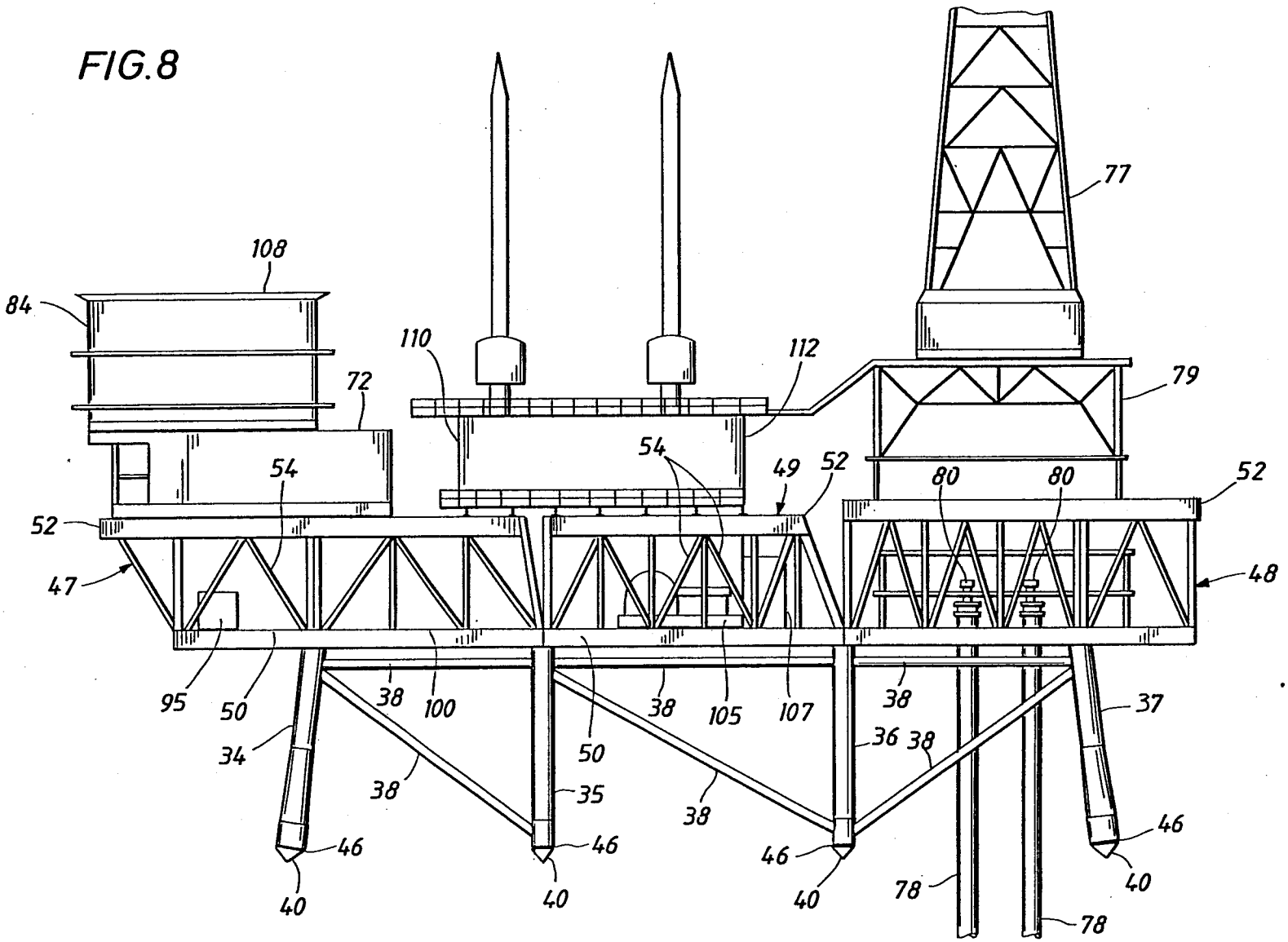
Figure 9:
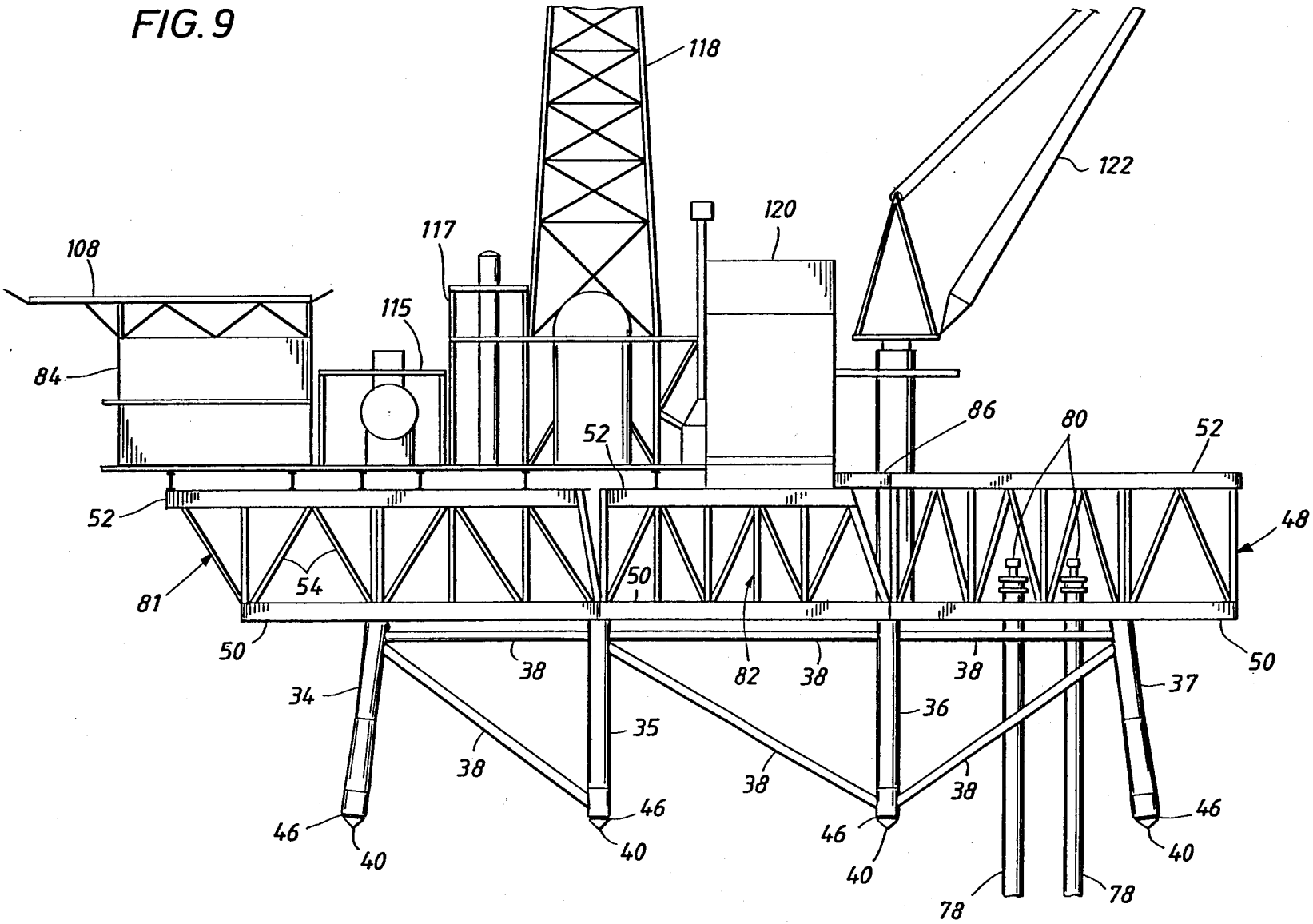

FIGS. 4*a*, 4*b* and 4*c* are diagrammatic views of the equipment container modules with FIG. 4*c* being an isometric view;

FIG. 5 is a longitudinal view of a form of anchoring means for aligning and orienting the module means to the substructure;

FIG. 6 is an expanded diagrammatic view showing an arrangement of drilling equipment modules, wellhead module, and related drilling equipment modules positioned on the substructure of the offshore platform apparatus;

FIG. 7 is a diagrammatic view illustrating an arrangement of the production equipment modules, wellhead module, and related production equipment positioned on the substructure of an offshore platform apparatus;

FIG. 8 is a diagrammatic view of the drilling equipment modules positioned adjacent to each other with associated drilling equipment located within and on the upper decks of these modules and also on the wellhead equipment module located adjacent to one drilling equipment module;

FIG. 9 is a side elevation of an offshore platform apparatus showing an arrangement of production equipment modules positioned adjacent to each other with associated production equipment located on top of these modules and the wellhead module located adjacent to one production equipment module;

FIG. 10 is a plan view of the lower deck of two facility modules and one well module illustrating a typical production equipment facilities layout; and FIG. 11 is a plan view of the lower deck of two facility modules and one well module illustrating another typical produetion equipment facilities layout.

DESCRIPTION OF THE PREFERRED EMBODIMENT

Referring to FIG. 1 of the drawing, an offshore platform jacket, generally represented by numeral 20, may comprise a plurality of tubular legs 22, interconnected by any arrangement of cross-bracing members 24. The legs 22 extend upwardly from the seabed or ocean floor 26 to a suitable level, say 12 feet, above the water surface 28. The jacket 20 is generally secured to the ocean floor 26 by driving piles 29 down through the tubular legs 22 into the ocean floor where they may be cemented or welded to the jacket legs. Bumpers or fenders 30 are generally provided on the legs 22 of the jacket to minimize any damage that may be caused by vessels making contact with the legs.

A substructure, represented by numeral 32 in FIG. 2, may comprise a plurality of legs 34, 35, 36 and 37 and are interconnected in a predetermined arrangement of bracing means or cross-bracing members 38 provide a spaced frame assembly to adopt the Jacket 20 top configuration to that required at the deck nodes 39. The upper ends or deck nodes 39 of the outer legs 34 and 37 of the substructure form a portion of the first landing surface means and are vertically spaced at, say 45 feet, from the upper ends of the inner legs 35 and 36, respectively, of the substructure as viewed in FIG. 2. The upper ends or deck nodes 39 of the inner legs 35 and 36 of the substructure form another portion of the first landing surface means and are vertically spaced at, say 60 feet. The lower ends of each member may be tapered 40 (FIG. 3) in order to facilitate orienting and stabbing the members 34, 35, 36, and 37 into the tops of the legs 42 of the jacket 20 which are provided with suitable cooperating orienting and aligning means. One form of aligning means, as shown in FIG. 3, may take the form of a downwardly-directed cone or pointed end 40 which is adapted to be stabbed into and seated on the upper end of the legs 22 of the jacket or the piling 29 extending thereabove. Thus, it may be seen that the lower ends of the legs of the substructure and the upper ends of the legs of the jacket are prevented from having any relative lateral movement by stabbing the lower end of the legs of the substructure into the upper ends of the legs of the jacket. Suitable anchoring means which limit relative vertical movement of the legs are provided, if desired, and may take any form such, for example, as set screws or locking screws 44 which may extend through the wall of the leg of the Jacket as shown in FIG. 3, and engage the shoulder 46 of the leg of the substructure. Alternatively, the legs of the substructure may be welded to the legs of the jacket.

Modular deck means, shown in FIGS. 4*a* 4*b*, and 4*c* comprise a plurality of elongated box-like framed equipment container modules 47, 48 and 49 of a length sufficient to span the outer members 34, 35, 36, and 37 of the substructure, when seated thereon. The width of the container modules 47, 48 and 49 is at least sufficient to span the pairs of members 34–34*a*, 35–35*a*, 36–36*a* and 37–37*a* (FIG. 11). The upper beams 52 and lower beams 50 of the container modules are connected by cross bracing members 54 forming a truss. Girders 56 (FIG. 4*c*) normal to the upper and lower beams of the container modules form the floor joists for the lower or second landing surface means and the upper modular deck means of the platform.

At least one module 48 (FIG. 4*b*) is of a height, say 28 feet, to contain a wellhead assembly of at least one well which is drilled through the module by equipment positioned above the module, thus forming a wellhead module 48. The matable orienting means carried by the lower deck of the wellhead module means 48 provides for aligning and orienting with at least four legs of the platform apparatus. For example, as shown in FIG. 5, the wellhead equipment module means 48 is provided with a matable orienting means whereby the lower deck or second landing surface means of the wellhead equipment module means engages with the extension 55*b* of the first landing surface means 39 of the substructure. The orienting means carried by the lower deck of each of the other equipment module means 47 and 49 are selectively arranged in the same spacing and configuration as at least a portion of the mating orienting means 55*a* carried by the upper ends 39 of each member of the platform apparatus on which they are to be positioned.

Connecting the wellhead module 48 to the platform apparatus may be accomplished by a variety of methods, such as welding. Suitable connector means carried by each of the drilling equipment modules 47 and 49 allows these modules to be removeably connected to the platform apparatus, such as by bolts 57, in a manner well known to the art.

The deck means as shown in FIG. 6 comprises three module means 47, 48, and 49, although two might be used on small platforms. Each module is the framework of beams in a box-like configuration, the floor of the interior of the box forming the deck beams of one portion of a platform deck and the top of the box forming a second deck at a selected elevation, say 25 feet, above the first deck. The modules 47 and 49 are adapted to contain equipment associated with the drilling of wells and thus form drilling equipment modules. A major portion of the auxiliary well drilling equipment is secured to and within these modules and is simultaneously removeable with the modules as a unit when drilling operations of the platform apparatus have been completed. Drilling equipment such as pipe rack packages 70, engine package 72, and living quarters 74 may be installed on the upper deck formed by the top of the drilling equipment modules 47 and 49. The upper deck may be provided with at least one crane unit 76 for handling pipe and other equipment on the platform.

The upper and lower floors of the wellhead module 48 are provided with one or more well bays or openings 160 (FIG. 10) through which a well conductor 78 (FIG. 8) is passed at the start of well drilling operations. A well conductor 78 is generally heavy-walled pipe, say, 26 inches in diameter, which is made up of 30 or 40 foot sections of pipe which are welded or screw threaded together, in a manner well known to the art, on the deck of the platform. A platform may have from one to 80 well conductors depending on the number of wells to be drilled. A drilling derrick 77 and its associated substructure 79 are positioned on the wellhead module 48 to carry out the drilling of the wells. After the drilling and completion of at least one well and assembling of wellhead equipment 80 for the well in the wellhead module 48, the drilling equipment on the upper deck is removed by a crane to a floating barge (not shown) in a manner well known to the art. Then the drilling equipment modules 47 and 49 containing drilling equipment are transported to another location such as a second jacket of an offshore platform positioned on the ocean floor together with its associated substructure or to onshore for use at a later time.

Alternatively, the deck module means may contain previously installed equipment 81 associated with the production of well fluids to form a production equipment module 82 as shown in FIG. 7. These modules are of a size and arrangement to be interchangeable with drilling equipment modules 47 and 49 after drilling operations on the platform have been completed. In this case, the platform is provided with two parallel lines of wells wherein the wellheads 80, and the well conductors 78 extending downwardly therefrom.

The top of the production equipment modules 82 form a second deck at a selected elevation, say 27 feet, above the first deck. Production equipment 81 which may be installed on the production equipment modules 82 includes living quarters 84, water flooding equipment 85, beams or walkways 86, a facilities skid 87 of equipment for separating and/or treating oil, gas and water mixtures, and compressor 88. On the wellhead equipment module 48 may be installed a production fluid treater 89 as well as at least a crane 90 for handling pipe and other equipment on the platform.

FIG. 8 illustrates an arrangement of at least two drilling equipment modules 47 and 49 positioned adjacent to each other with the wellhead equipment module 48 positioned at the end of the platform apparatus. The drilling equipment modules 47 and 49 may contain a sewage treatment plant 95, liquid storage facilities 100, mud pumps 105, an active mud tank 107, etc. In addition to the engine package 72 and the living quarters 84, a heliport 108 may be positioned on the living quarters 84. Additionally, a pneumatic tank package 110 and a cement sack storage facility 112 may be located on the upper deck of the drilling equipment modules 47 and 49. A derrick 77 and its associated substructure 79 may be positioned on the wellhead module 48.

As mentioned earlier, the drilling equipment modules 47 and 49 may be removed as separate units when the well drilling operation of the platform has been completed. Production equipment modules 81 and 82, being of a size and arrangement to be interchangeable with drilling equipment modules 47 and 49 next to the wellhead module 48 after drilling operations have been completed, are shown in FIG. 9. Additional production equipment may be located on the top deck of the production equipment modules 81 and 82. This equipment may include a production fluid treater 115, a production facilities package 117 including a flare tower 118, a compressor 120, a platform crane 122 and a beam or walkway 86.

Production equipment associated with producing of wells to form production equipment modules 81 and 82, which may be secured to and within the module so as to be simultaneously removeable with the modules as a unit, are shown in FIG. 10. This equipment may be arranged on the floor of the interior of the production equipment modules which form one portion of the platform deck. The two production equipment modules 81 and 82 are positioned adjacent to each other with the wellhead module 48 adjacent to only one production equipment module, in a configuration known as end bay drilling. One lower deck arrangement of the modules 81, 48 and 82 may contain production equipment including utility equipment 124, gas meters 142, pig launchers/receivers 125, a sewage treatment plant 95, water flood equipment 85, and overhead crane 122, a safe welding area 126, an equipment storage 127, a microwave building 128, air compressor 129, salt water pumps 130, heat medium equipment 131, sumps 132, volumetric measuring and recording device 133, a generator building 134, wet oil pumps 135, a wet/dry oil tank 136, pipeline pumps 137 as well as an area for future pipeline pumps 138, well manifolds 139, wellheads 80, gas lift equipment 141, and helicopter fuel 140. Stairs are provided in modules 81 and 82 for walking up to the upper decks.

An alternate configuration for the equipment modules is shown in FIG. 11. The production equipment modules 81 and 82 in this case are positioned on opposite sides of the wellhead module 48. This configuration is also known as center bay drilling. Production equipment located on the lower deck of the production module 81 may include an escape capsule 155, a sewage treatment plant 95, a cold start air compressor 151, a storage building 127, a utility equipment skid 124, a safe welding area 126, a generator building 134, pig launcher/receivers 125, and a monorail for these receivers 153. The other production equipment module 82 may include a gas meter 142, a wet/dry oil tank 136, a volumetric measuring and recording device 133, a wet oil pump 135, a microwave building 128, pipeline pumps 137 as well as an area for future pipeline pumps 138. The wellhead equipment module 48 lower deck may contain a helicopter fuel storage area 140, gas lift equipment 141, salt water pumps 130, manifolds 139, wellheads 80 and sumps 132.

What is claimed is:

1. A permanently fixed offshore platform apparatus from which at least one well is drilled, said apparatus comprising:

a jacket having a plurality of legs anchored to and upwardly extending from the ocean floor to above the water surface;

a substructure having a plurality of legs positioned on said jacket and fixedly secured thereto;

bracing means connected between and to the legs of said substructure to fixedly position and space at least the upper ends of the legs in a predetermined arrangement;

first landing surface means carried by the upper ends of a plurality of said substructure legs;

modular deck means provided with second landing surface means on the bottom thereof for engaging said first landing surface means of said substructure, said modular deck means comprising a plurality of elongated box-like framed equipment container modules of a length sufficient to span said outer legs of said substructure when seated thereon, at least one of said modules being of a height to extend above and contain a wellhead assembly of a well drilled through said module by a well-drilling assembly when it is positioned on and above said module, whereby a wellhead module is formed;

matable orienting means for aligning and orienting said modular deck means on said substructure, said orienting means comprising first and second portions, the first being carried by said substructure and the second portion being carried by said modular deck means;

a well drilling derrick and associated equipment mounted on a portion of said modular deck means and located above a point where a well is to be drilled; and connecting means for connecting said modular deck means to said substructure.

2. The apparatus of claim 1 wherein another of said deck means modules is removably connected to said permanently fixed platform apparatus from which at least one well is drilled and is adapted to contain equipment associated with the drilling of a well to form a drilling equipment module, the major portion of said equipment being secured to and within said module and being simultaneously removed with said module as a unit when drilling operations on the platform apparatus have been completed.

3. The apparatus of claim 1 wherein a substitute modular deck means contains previously installed equipment associated with the production of well fluids to form a production equipment module, said substitute module being of a size and arrangement to replace the drilling equipment module next to the wellhead module after drilling operations on the platform apparatus have been completed.

4. A permanently fixed offshore platform apparatus from which at least one well is drilled, said apparatus comprising:

a jacket having a plurality of legs anchored to and upwardly extending from the ocean floor to a selected level above the water surface;

modular deck means formed by a plurality of container modules and being provided with landing surfaces for landing on said jacket, said modular deck means comprising a plurality of elongated box-like framed equipment container modules of a length sufficient to span said outer legs of said jacket when seated thereon, at least one of said modules being of a height to extend above and contain a wellhead assembly of a well drilled through said module by a well-drilling assembly when it is positioned on and above said module, whereby a wellhead module is formed;

matable orienting means for aligning and orienting said modular deck means on said jacket, said orienting means comprising first and second portions, the first portion carried by said jacket and the second portion carried by said modular deck means;

a well drilling derrick and associated equipment mounted on a portion of said modular deck means and located above a point where a well is to be drilled; and

5. For use on a permanently fixed offshore drilling platform apparatus from which at least one well is drilled, the apparatus having a plurality of legs anchored to and upwardly extending from the ocean floor to above the water surface, modular deck means being a framework of beams in a box-like configuration, the floor of the interior of the box forming one portion of a platform deck and the top of said box forming a portion of the second deck at a selected elevation above the first deck, said deck means comprising:

wellhead module means adapted to be removably secured to the top of the legs of said platform apparatus, drilling equipment module means adapted to be removable secured to the top of the legs of said platform apparatus in a side-by-side configuration with respect to said wellhead module means, matable orienting means for aligning and orienting said module means on said platform apparatus, said orienting means being of a selected spacing and configuration sufficient to mate said module means on said platform apparatus, and connector means for connecting said module means to said platform apparatus, said connector means carried by each of said drilling equipment module means for removably connecting each of said drilling equipment module means to said platform apparatus and connector means carried by said wellhead module means for connecting said wellhead module means to said platform apparatus.

6. A method of drilling offshore multiple wells at spaced locations from a permanently fixed offshore platform, the method comprising the steps of:

positioning a well jacket anchored to and extending from the ocean floor to a point above the water surface at a selected offshore location to form the base of an offshore platform having upper and lower decks;

lowering a substructure on said jacket above the water surface and fixedly securing the bottom of said substructure to the top of said jacket;

providing a plurality of double deck modules of sufficient length to span the entire substructure in one direction, at least one of said modules being empty and adapted to subsequently receive well apparatus, at least one of said modules containing previously installed drilling equipment therein, and at least one substitute module contaning previously installed equipment associated with the production of well fluids to form a production equipment module said substitute module being of a size and arrangment to replace said drilling equipment module next to the wellhead module after drilling operations on the platform apparatus have been completed;

installing a derrick and drilling equipment on the top of said empty module forming a portion of the upper deck of said platform;

forming a deck by installing a plurality of double deck modules on said substructure arranged in a side-by-side configuration; and connecting the double deck modules to said substructure.

7. The method of claim 6 including the step of drilling and completing at least one well from said fixed offshore platform and assembling wellhead equipment for the well in the empty module.

8. The method of claim 7 including the step of removing the derrick and drilling equipment from the upper deck of said platform.

9. The method of claim 8 including the step of removing the drilling equipment module containing drilling equipment within said module.

10. The method of claim 9 including the step of transporting said drilling equipment module to a second location.

11. The method of claim 10 including the steps of providing at said second location a second jacket positioned on the ocean floor together with its associated substructure and well module located above the water surface, and installing said drilling equipment module on said second substructure.

12. The method of claim 9 including the steps of installing on said platform substructure a production equipment module at the location from which said drilling equipment module was removed, and connecting said production equipment of said module to at least one wellhead of said platform.

13. The method of claim 12 including the step of fixedly securing the production equipment module to said substructure.

14. A method for drilling and producing at least one well on an offshore platform comprising:

mounting a removable drilling equipment module on said offshore platform;

drilling said at least one well with said removable drilling equipment module; and replacing said removable drilling equipment module with an interchangeable production equipment module.

15. A method for drilling and producing at least one well on a permanent offshore platform comprising:

mounting a removable drilling equipment module on said offshore platform;

drilling said at least one well with said removable drilling equipment module; and replacing said removable drilling equipment module with an interchangeable production equipment module.

16. The method of claim 14 or 15 including producing said at least one well with said interchangeable production equipment module.

17. The method of claim 14 or 15 including moving said drilling equipment module to another location.

18. The method of claim 17 wherein said location is a separate offshore platform.

19. The method of claim 14 or 15 including mounting said drilling equipment module on a substructure which is mounted on a jacket which extends to the ocean floor.

20. An apparatus for drilling and producing at least one well on an offshore platform comprising:

means for mounting a removable drilling equipment module on said offshore platform;

means for drilling said at least one well with said removable drilling equipment module; and means for replacing said removable drilling equipment module with an interchangeable production equipment module.

21. An apparatus for drilling and producing at least one well on a permanent offshore platform comprising:

means for mounting a removable drilling equipment module on said offshore platform;

means for drilling said at least one well with said removable drilling equipment module; and means for replacing said removable drilling eqiupment module with an interchangeable production equipment module.

22. The apparatus of claims 20 or 21 including means for producing said at least one well with said interchangeable production equipment module.

* * * * *